US005617581A

United States Patent [19]

Robbins

[11] Patent Number: 5,617,581

[45] Date of Patent: Apr. 8, 1997

[54] INSULATING UNDERGARMENT

[76] Inventor: Cameron J. Robbins, NEMOC PSC 819 Box 31, FPO AE, 09645-3200

[21] Appl. No.: 523,773

[22] Filed: Sep. 5, 1995

[51] Int. Cl.[6] ..... A41D 1/00; A41D 3/00

[52] U.S. Cl. ..... 2/69; 2/78.2; 2/234

[58] Field of Search ..... 2/2.15, 2.16, 2.17, 2/914, 913, 915, 916, 919, 78.2, 234, 82, 100, 158, 159, 162, 22, 23, 239

[56] References Cited

U.S. PATENT DOCUMENTS

| | | | |
|---|---|---|---|
| Re. 33,966 | 6/1992 | Robison | 2/914 X |
| 1,512,171 | 10/1924 | Homling | 2/78.2 |
| 1,853,396 | 4/1932 | Atherton | 2/78.2 |
| 2,749,551 | 6/1956 | Garbellano | 2/2.15 X |
| 3,088,116 | 5/1963 | Simonoff | 2/78.2 X |
| 3,744,053 | 7/1973 | Parker et al. | 2/2.16 |
| 3,925,839 | 12/1975 | Smith | 2/2.15 X |
| 4,389,733 | 6/1983 | Boykins, Jr. | 2/234 X |
| 4,788,733 | 12/1988 | Lerner | 2/159 X |
| 4,809,447 | 3/1989 | Pacanowsky et al. | 2/239 X |
| 5,375,263 | 12/1994 | Cuccia | 2/158 |
| 5,406,648 | 4/1995 | Butzer et al. | 2/100 X |

*Primary Examiner*—G. D. Crowder
*Assistant Examiner*—Shirra L. Jenkins

[57] ABSTRACT

An insulating garment including a cap. The cap has an eyehole and is positionable over a head. Included is a body suit for covering an area of a body. The body suit has an upper portion with a pair of shoulder straps extending therefrom, a lower portion forming a pair of leg ends and a middle portion therebetween. The suit has a front side and a rear side. The front side has a fly positioned thereon and spaced from a waist area of the suit on the middle portion. The rear side has a posterior opening with a top portion along the middle portion and a pair of vertical coupling members. Also included are a pair of boots. Each has an upper end for positioning over a respective leg end of the lower portion of the suit. A jacket is provided. The jacket has a collar and jacket sleeves for positioning over the body suit when worn. Lastly, a pair of gloves are included. The gloves have an upper end for positioning over a respective short sleeve of the jacket.

1 Claim, 3 Drawing Sheets

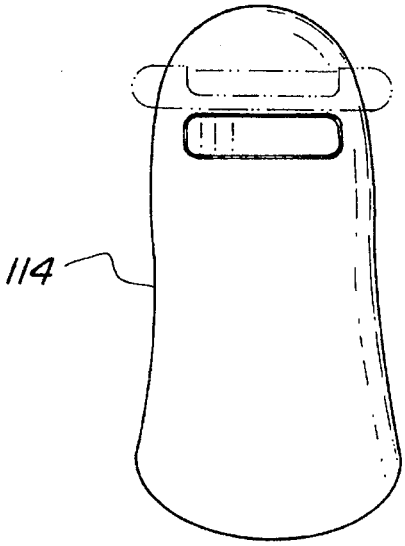
Fig. 5
Fig. 6
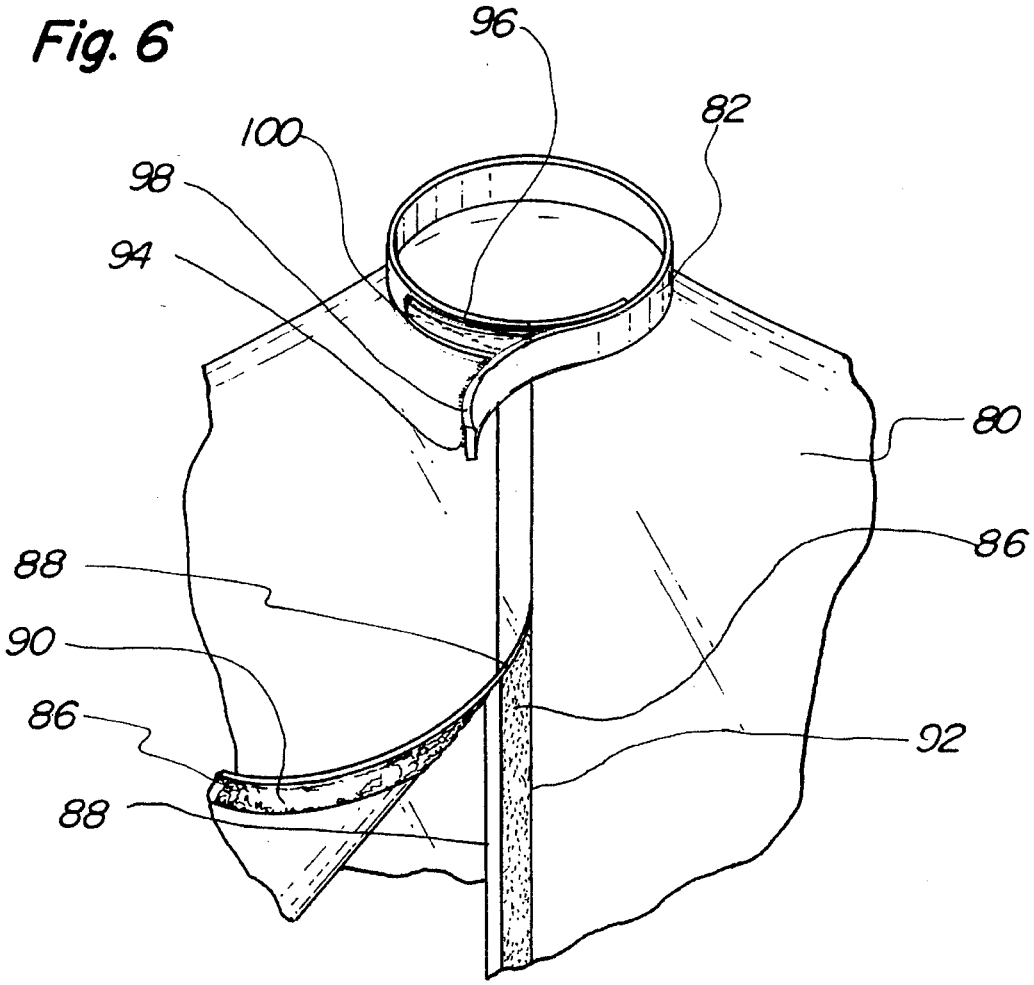

INSULATING UNDERGARMENT

BACKGROUND OF THE INVENTION

1. Field of the Invention

The present invention relates to a insulating undergarment and more particularly pertains to insulating the human body from cold weather when worn and further protects normally exposed areas by overlapping various parts of the garment components over various body parts.

2. Description of the Prior Art

The use of undergarments is known in the prior art. More specifically, undergarments heretofore devised and utilized for the purpose of keeping the body warm are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,206,957 to Gulick discloses a body core warming vest. U.S. Pat. No. 5,153,939 to Howe et at. discloses a knit fabric material having stretch and insulation properties for use in clothing articles. Lastly, U.S. Pat. No. 4,185,327 to Markve discloses a ventilating and insulating garment formed of moldable material containing a plurality of spherical air pockets.

While these devices fulfill their respective, particular objectives and requirements, the aforementioned patents do not describe insulating undergarment that provides persons having to work or play in cold weather a comfortable insulating undergarment that covers the entire body from head to toe while covering areas of the body normally exposed by other under garments.

In this respect, the insulating undergarment according to the present invention substantially departs from the conventional concepts and designs of the prior art, and in doing so provides an apparatus primarily developed for the purpose of to insulating the human body from cold weather when worn and further protects normally exposed areas by overlapping various parts of the garment components over various body parts.

Therefore, it can be appreciated that there exists a continuing need for a new and improved insulating undergarment which can be used for insulating the human body from cold weather when worn and further protects normally exposed areas by overlapping various parts of the garment components over various body parts. In this regard, the present invention substantially fulfills this need.

SUMMARY OF THE INVENTION

In view of the foregoing disadvantages inherent in the known types of under garments now present in the prior art, the present invention provides an improved insulating undergarment. As such, the general purpose of the present invention, which will be described subsequently in greater detail, is to provide a new and improved insulating undergarment and method which has all the advantages of the prior art and none of the disadvantages.

To attain this, the present invention essentially comprises a body suit for covering an area of a body. The body suit has an upper portion, a lower portion and a middle portion therebetween. The suit has a front side and a rear side. The upper potion has a pair of shoulder straps for support of the suit over the chest area. Each shoulder strap has a length. The length allows each strap to extend from the rear side to crisscross over each other along an upper back of the body. Each strap is then positioned over a respective shoulder to couple onto the upper portion on the front side. Each shoulder strap has an end portion with a pile-type fastener assembly thereon. The front side has a fly positioned along the middle portion. The fly has a pile-type fastener assembly being positioned thereon for allowing opening and closing as needed by the wearer. The rear side has a posterior opening along the middle portion. The posterior opening is positioned near a middle portion of the back and extends vertically to a rear thigh area of each of the legs of a wearer. The posterior opening has a top portion horizontally extending along the middle back with a pile-type fastener assembly on an interior side for affixing to a pile-type fastener on an exterior side of the middle portion of the body suit. The posterior opening further has a pair of vertical coupling members extending downwardly from the top portion. The coupling members are capable of opening and closing. Also included are a pair of boots. Each boot has an upper end with an under role thereon. The under role has a drawstring positioned therein. Each boot has a boot sole. The upper end of each boot is positionable over the lower portion of the suit when the suite being worn over a body. A jacket is provided. The jacket has a jacket front, a collar and jacket sleeves. The jacket front has a pair of front flaps. Each front flap has a pile-type fastener assembly for affixing to the pile-type fastener of another front flap for opening and closing of the jacket front. The collar has on one side a collar extent for overlapping of an opposite side of the collar. The collar extent has a pile-type fastener assembly for coupling the pile-type fastener of the opposite side of the collar when the front flaps of the jacket being in a closed orientation. The jacket is positioned over the suit when the suit is worn over the body. Included is a pair of gloves. Each glove has an upper end with an upper roll thereon. The upper roll has a drawstring therein. Each glove is positionable over a hand and a portion of an arm. Each glove is capable of being positioned over a portion of a respective sleeve of the jacket when the jacket is worn. Lastly, a cap is provided. The cap has an eyehole and is capable of being loosely positioned over a head of a person.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved insulating undergarment which has all of the advantages of the prior art under garments and none of the disadvantages.

It is another object of the present invention to provide a new and improved insulating undergarment which may be easily and efficiently manufactured and marketed.

It is further object of the present invention to provide a new and improved insulating undergarment which is of durable and reliable constructions.

An even further object of the present invention is to provide a new and improved insulating undergarment which is susceptible of a low cost of manufacture with regard to both materials and labor, and which accordingly is then susceptible of low prices of sale to the consuming public, thereby making such insulating undergarment economically available to the buying public.

Still yet another object of the present invention is to provide a new and improved insulating undergarment which provides in the apparatuses and methods of the prior art some of the advantages thereof, while simultaneously overcoming some of the disadvantages normally associated therewith.

Even still another object of the present invention is to provide a insulating undergarment for insulating the human body from cold weather when worn and further protects normally exposed areas by overlapping various parts of the garment components over various body parts.

Lastly, it is an object of the present invention to provide a new and improved insulating garment including a cap. The cap has an eyehole and is positionable over a head. Included is a body suit for covering an area of a body. The body suit has an upper portion with a pair of shoulder straps extending therefrom, a lower portion forming a pair of leg ends and a middle portion therebetween. The suit has a front side and a rear side The front side has a fly positioned thereon and spaced from a waist area of the suit on the middle portion. The rear side has a posterior opening with a top portion along the middle portion and a pair of vertical coupling members. Also included are a pair of boots, with each having an upper end, for positioning over a respective leg end of the lower portion of the suit. A jacket is included. The jacket has a collar and jacket sleeves for positioning over the body suit when worn. Finally, a pair of gloves are provided. The gloves have an upper end for positioning over a respective sleeve of the jacket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an elevational view of the cap of the present invention unrolled.

FIG. 6 is a sectional view of the collar of the present invention in a closed orientation.

The same reference numerals refer to the same parts through the various Figures.

DESCRIPTION OF THE PREFERRED EMBODIMENT

Figure 1:
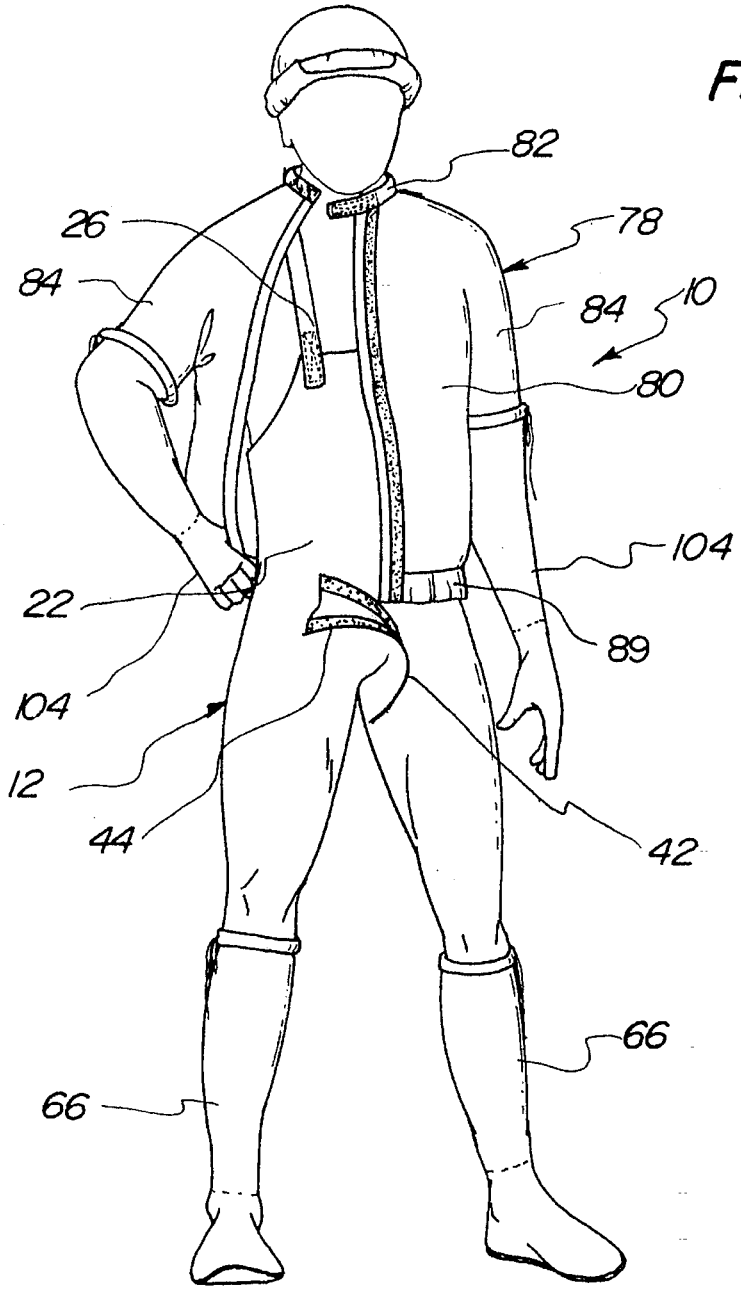
FIG. 1 is a perspective view of the preferred embodiment of the insulating undergarment constructed in accordance with the principles of the present invention.

With reference now to the drawings, and in particular to FIG. 1 thereof, the preferred embodiment of the new and improved insulating undergarment embodying the principles and concepts of the present invention and generally designated by the reference numeral 10 will be described.

The present invention, the insulating undergarment 10 is comprised of a plurality of components. Such components in their broadest context include a cap, a body suite, a jacket, a pair of boots, and a pair of gloves. Such components are individually configured and correlated with respect to each other so as to attain the desired objective.

Figure 4:
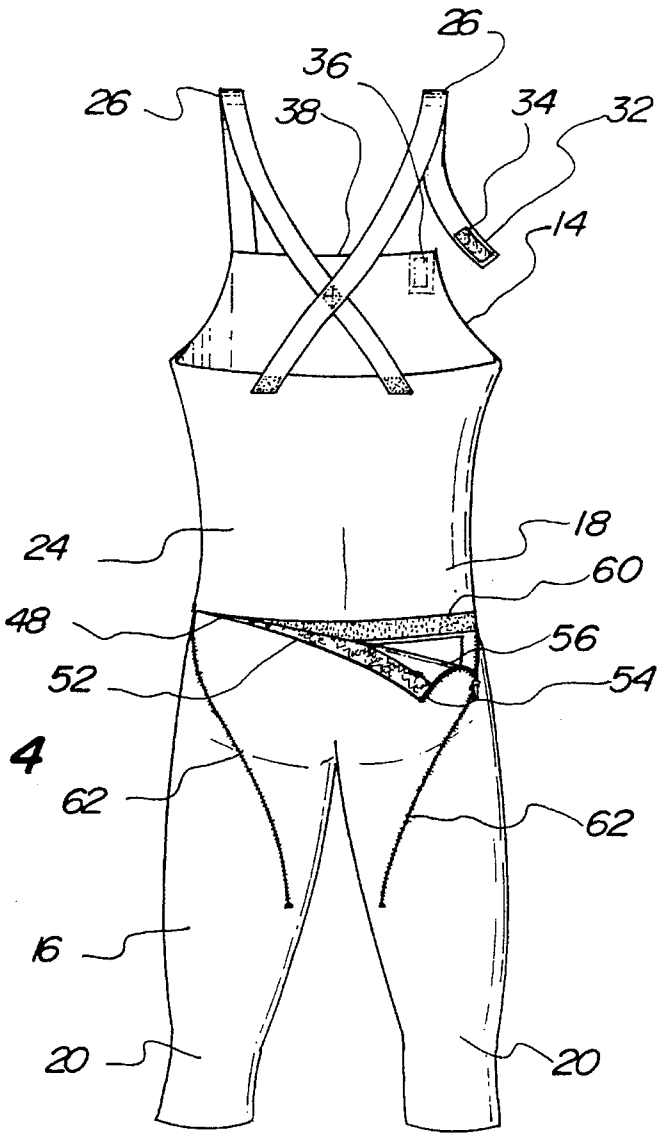
FIG. 4 is a rear view of the body suit of the present invention in an operable configuration.
Figure 3:
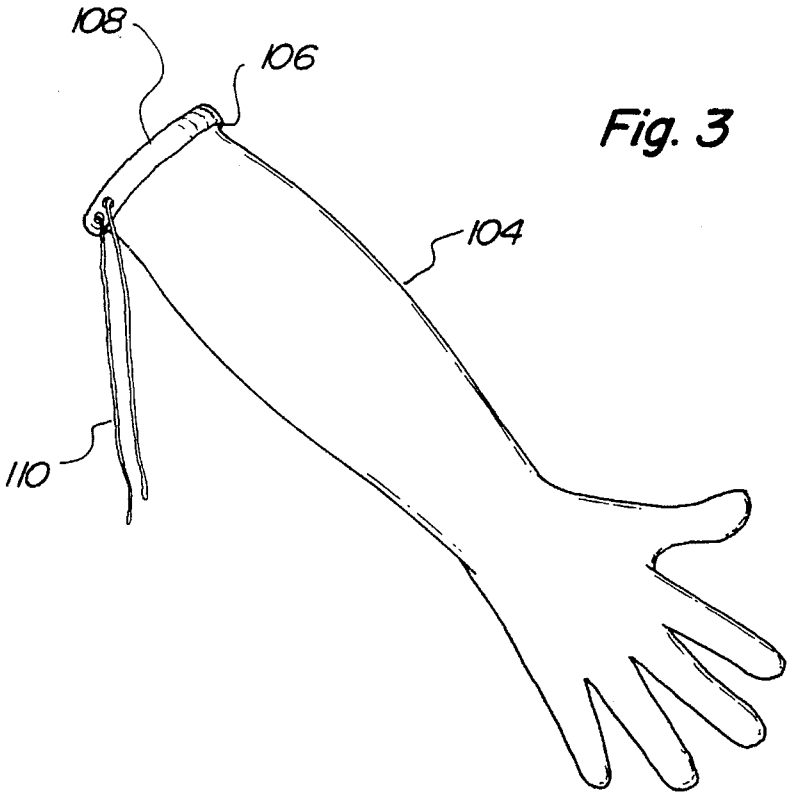
FIG. 3 is an elevational view of the glove of the present invention of FIG. 1.

Specifically, the present invention as shown in FIG. 1 includes a body suit 12 for covering an area of a body. The body suit is formed of an insulating and breathable fabric that has some elastic properties. As best illustrated in FIG. 4, the body suit has an upper portion 14, a lower portion 16 and a middle portion 18 therebetween. The upper portion of the body suit is positioned over the chest and upper back area of the wearer. The lower portion of the body suit has a pair of leg ends 20. Each leg end extending from just below the buttocks to just above the ankle. The middle portion covering from the waist to the upper area of the thigh. The suit has a front side 22 and a rear side 24. The upper potion has a pair of adjustable length shoulder straps 26 for supporting the suit over the chest area. Each shoulder strap has a length for allowing each strap to extend from the rear side to criss-cross over each other along an upper back part of the body. Each strap then is positioned over a respective shoulder to couple onto the upper portion on the front side. Each shoulder strap has an end portion 32 with a pile-type fastener assembly 34 thereon, The pile-type fastener of each strap is capable of affixing to the pile-type fastener 36 of an upper edge 38 of the upper portion.

The front side 22, as shown in FIG. 1, has a fly 42. The fly is positioned along the middle portion just below the waist. The fly of the present invention has a new design for more comfort and ease of opening. The fly is shaped and sized for positioning across the upper area of the thigh of the wearer and is opened with a side-ways motion. The fly has a pile-type fastener assembly 44 that is positioned thereon for allowing opening and closing of the fly as needed by the wearer. The rear side 24, as shown in FIG. 4, has a posterior opening 48 along the middle portion 18. The posterior opening is positioned near a middle portion of the back of the body and extending vertically to a rear thigh area of each of the legs of a wearer. The posterior opening has a top portion 52 horizontally extending along the middle back. The top portion has a pile-type fastener assembly 54 on an interior side 56 for affixing to a pile-type fastener 60 on an exterior side 24 of the middle portion of the body suit. The posterior opening further has a pair of vertical coupling members 62 extending downwardly from the top portion. The vertical coupling members are zippers that are capable of opening and closing when the top portion is opened and closed. The zippers are preferably formed of plastic.

Figure 2:
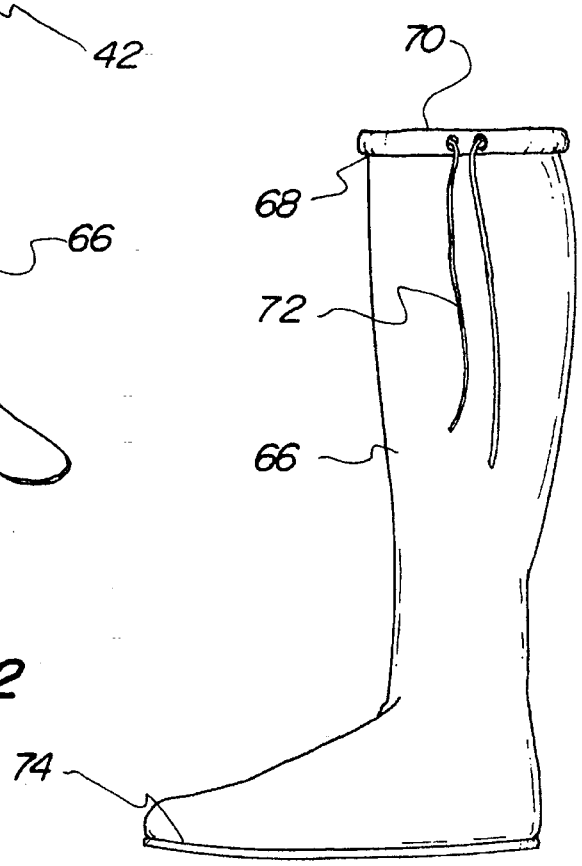
FIG. 2 is a side view of the boot of the present invention of FIG. 1.

Also included are a pair of boots 66. Each boot, as shown in FIG. 2, has an upper end 68 with an under role 70 thereon. The under role has a drawstring 72 positioned therein. Each boot has a boot sole 74. The sole of the boot is formed of a synthetic leather material for water resistance. The upper end of each boot is positionable over the lower portion of the suit just below the knee. Each boot is positioned thereon when the suit is worn over a body. The drawstring of each boot is pulled tight when the boot in over a respective leg of the suit. Tightening the drawstring secures each boot around the leg.

As best illustrated in FIG. 1, a jacket 78 is included. The jacket has a jacket front 80, a collar 82 and jacket sleeves 84. The jacket front has a pair of front flaps 86, as illustrated in FIG. 6. Each front flap has flap edges 88 extending from the collar to the bottom 89 of the jacket. The bottom of the jacket is elasticized to provide a tight fit around the waist of the wearer of the body suit. The tight fit of the bottom of the jacket prevents the entrance of cool air and the retention of body heat. One flap edge has a pile-type fastener assembly 90 for affixing to the pile-type fastener 92 of another flap edge for opening and closing of the jacket front, as shown in FIG. 6. The collar has on one side a collar extent 94 for overlapping of an opposite side 96 of the collar. The collar extent has a pile-type fastener assembly 98 for coupling the pile-type fastener 100 of the opposite side of the collar when the flap edges of the jacket are in a closed orientation. The jacket is positionable over the suit when the suit is worn over the body.

Furthermore, a pair of gloves 104 are provided. Each glove has an upper end 106 with an upper roll 108 thereon. The upper roll has a drawstring 110 therein. Each glove is positioned over a hand and a portion of an arm. Each glove is capable of being positioned over a portion of a respective sleeve 84 of the jacket when the jacket is worn. The drawstring of each glove is pulled tight when the glove in over a respective arm of the suit. Tightening the drawstring secures each glove around the arm.

Lastly, as illustrated in FIG. 5, a cap 114 is included. The cap has an eyehole and is capable of being loosely positioned over a head of a person. The cap may be rolled up over and above the eyes of the wearer when the cap is in use.

The present invention is an insulating undergarment that provides extra protection to the waist, wrist, ankles and neck of the wearer. The extra protection is provided because the components of the undergarment over lap in the area of those body parts. The insulating undergarment is formed of light weight insulating material that may be worn comfortably under regular clothing. The present invention will allow full range of body movement when worn. The present invention is structured to be worn by hunters, construction workers, and others that have to perform tasks outside or in a cold environment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An insulating garment for protection of a body from the elements of cold weather comprising in combination:

a body suit for covering an area of a body formed of an insulating and breathable fabric having elastic properties, the body suit having an upper portion, a lower portion and a middle portion therebetween, the suit having a front side and a rear side, the upper portion having a pair of shoulder straps for supporting the suit over the chest area, each shoulder strap having a length for extending from the rear side to criss-cross over each other along an upper back of the body, then being positioned over a respective shoulder to couple onto the upper portion on the front side, each shoulder strap having an end portion with a pile-type fastener assembly thereon;

the front side having a fly positioned along the middle portion, the fly being shaped and sized for positioning across the upper area of the thigh, the fly having a pile-type fastener assembly being positioned thereon for allowing opening and closing as needed by the wearer, the fly being opened and closed by the wearer using a side-ways motion, the rear side having a posterior opening along the middle portion, the posterior opening being positioned near a middle portion of the back and extending vertically to a rear thigh area of each of the legs of a wearer, the posterior opening having a top portion horizontally extending along the middle back with a pile-type fastener assembly on an interior side for affixing to a pile-type fastener on an exterior side of the middle portion of the body suit, the posterior opening further having a pair of vertical coupling members extending downwardly from the top portion and capable of opening and closing;

a pair of boots, each boot having an upper end with an under role thereon, the under role having a drawstring positioned therein, each boot having a boot sole, the upper end of each boot positionable over the lower portion of the suit when the suit being worn over the body;

a jacket having a jacket front, a collar and jacket sleeves, the jacket front having a pair of front flaps that extend from the collar to a bottom of the jacket, the bottom of the jacket being elasticized for providing a tight fit around the waist of the wearer for the retention of body heat when the front flaps being closed, one front flap having a pile-type fastener assembly for affixing to the pile-type fastener of another front flap for opening and closing of the jacket front, the collar having on one side a collar extent for overlapping of an opposite side of the collar, the collar extent having a pile-type fastener assembly for coupling the pile-type fastener of the opposite side of the collar when the front flaps of the jacket being in a closed orientation, the jacket being positionable over the suit when the suit being worn over the body;

a pair of gloves with each glove having an upper end with an upper roll thereon, the upper roll having a draw string therein, each glove being positionable over a hand and a portion of an arm, each glove capable of being positioned over a portion of a respective sleeve of the jacket when the jacket being worn; and a cap having a eyehole and capable of being loosely positioned over a head of a person.

* * * * *